US009280138B2

(12) United States Patent
Itani

(10) Patent No.: US 9,280,138 B2
(45) Date of Patent: Mar. 8, 2016

(54) IMAGE FORMING APPARATUS THAT USES EITHER A HEATER OR FRICTIONAL HEATING TO HEAT AND DRY A SURFACE OF A PHOTOCONDUCTIVE DRUM BASED ON THE DETECTED AMBIENT TEMPERATURE AND HUMIDITY

(71) Applicant: KYOCERA Document Solutions Inc., Osaka (JP)

(72) Inventor: Hiroka Itani, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 14/297,405

(22) Filed: Jun. 5, 2014

(65) Prior Publication Data

US 2014/0363180 A1 Dec. 11, 2014

(30) Foreign Application Priority Data

Jun. 7, 2013 (JP) ..... 2013-121336

(51) Int. Cl.
*G03G 21/20* (2006.01)
*G03G 21/00* (2006.01)

(52) U.S. Cl.
CPC ..... *G03G 21/203* (2013.01); *G03G 21/0094* (2013.01)

(58) Field of Classification Search
CPC . G03G 21/20; G03G 21/203; G03G 21/0058; G03G 15/5008; G03G 15/5033; G03G 15/5045
See application file for complete search history.

(56) References Cited

U.S. PATENT DOCUMENTS 5,689,768 A * 11/1997 Ehara ..... G03G 21/203 399/159
6,198,491 B1 * 3/2001 Honda ..... 347/129
7,620,343 B2 * 11/2009 Miyaji et al. ..... 399/96
2011/0170895 A1 * 7/2011 Fujiya ..... G03G 21/20 399/94
2014/0294410 A1 * 10/2014 Hayashi ..... G03G 21/203 399/44
2014/0321879 A1 * 10/2014 Sato ..... 399/97
2014/0348522 A1 * 11/2014 Tomono ..... G03G 15/50 399/44

FOREIGN PATENT DOCUMENTS

JP 2000-147983 5/2000

* cited by examiner

*Primary Examiner* — Clayton E Laballe
*Assistant Examiner* — Trevor J Bervik

(57) ABSTRACT

An image forming apparatus includes a slidingly-rubbing roller abutting a surface of a photoconductive drum; a temperature detection section; a humidity detection section; and a heating control section. When the humidity detected by the humidity detection section is equal to or higher than a first threshold humidity and the temperature detected by the temperature detection section is equal to or higher than a threshold temperature, the heating control section heats and dries the surface of the photoconductive drum by a heat generator, while in a case when the humidity is equal to or higher than the first threshold humidity and the temperature is less than the threshold temperature, the heating control section polishes the surface of the photoconductive drum by the slidingly-rubbing roller with a polishing agent contained in a toner and heats and dries the drum surface by frictional heat generated from the polishing.

7 Claims, 9 Drawing Sheets

Fig.8

| | | | | | | | | | | |
|---|---|---|---|---|---|---|---|---|---|---|
| CONDITION | NUMBER OF COPIES TO BE TESTED | 100,000 | | | 200,000 | | | 400,000 | | |
| | IN-APPARATUS TEMPERATURE | 10℃ | | | 10℃ | | | 10℃ | | |
| | IN-APPARATUS HUMIDITY | 60% | 80% | 100% | 60% | 80% | 100% | 60% | 80% | 100% |
| RESULTS | RELATED ART | △ | × | ○ | × | × | ○ | × | × | ○ |
| | FIRST EMBODIMENT | ○ | ○ | ○ | ○ | ○ | ○ | ○ | ○ | ○ |
| | SECOND EMBODIMENT | ○ | ○ | ○ | ○ | ○ | ○ | ○ | ○ | ○ |

IMAGE FORMING APPARATUS THAT USES EITHER A HEATER OR FRICTIONAL HEATING TO HEAT AND DRY A SURFACE OF A PHOTOCONDUCTIVE DRUM BASED ON THE DETECTED AMBIENT TEMPERATURE AND HUMIDITY

INCORPORATION BY REFERENCE

This application claims priority to Japanese Patent Application No. 2013-121336 filed on 7, Jun., 2013, the entire contents of which are incorporated by reference herein.

BACKGROUND

This disclosure relates to an image forming apparatus. Typically, an electrophotographic image forming apparatus includes: a photoconductive drum, and a charger that charges a surface of the photoconductive drum This charger is arranged around the photoconductive drum, and generates nitrogen oxide called ozone or NOx when it is in operation. At this point, the ozone with strong oxidation power oxidizes the surface of the photoconductor, deteriorating resistance of this surface. Moreover, reaction of the nitrogen oxide to moisture in air generates an ion product such as nitric acid or ammonium, and this ion product is water-soluble and thus its adhesion to the surface of the photoconductive drum results in intake of moisture from the atmosphere, deteriorating resistance of this surface. This consequently raises a problem that side flow occurs in potential at an edge part of an electrostatic latent image formed on the surface of the photoconductive drum, causing deterioration in image quality of a printed image.

To solve this problem, for example, there is an image forming apparatus which has a heat generator built in a photoconductive drum and which dries a surface of the photoconductive drum by heat generation from this heat generator to remove moisture as a factor contributing to the deterioration in surface resistance of the photoconductive drum. This image forming apparatus is a monochrome machine having only one image formation unit.

Due to increasing demands for space saving (downsizing) of an image forming apparatus in recent years, there are demands for arranging, in limited space, a photoconductive drum and its accompanying components such as a developing device and a toner collecting container.

However, in the image forming apparatus described above, attempts to achieve the space saving results in a problem that a toner in the developing device and the toner collecting container is condensed by heat from the heat generator of the photoconductive drum due to dense packing of the photoconductive drum and the components such as the developing device and the toner collecting container in the narrow space.

SUMMARY

As one aspect of this disclosure, a technology obtained by further improving the technology described above is suggested.

An image forming apparatus according to one aspect of this disclosure includes: a photoconductive drum, a charger, an exposing device, a developing device, a transfer member, a heat generator, a heating control section, a slidingly-rubbing roller, a temperature detection section, and a humidity detection section.

The charger charges a surface of the photoconductive drum.

The exposing device exposes the surface of the photoconductive drum to form an electrostatic latent image thereon.

The developing device develops the electrostatic latent image formed on the photoconductive drum by a toner to thereby obtain a toner image.

The transfer member transfers the toner image onto a transfer object at time of image formation.

The heat generator is for heating and drying the photoconductive drum.

The heating control section controls operation of the heat generator.

The slidingly-rubbing roller abuts the surface of the photoconductive drum

The temperature detection section detects an atmospheric temperature.

The humidity detection section detects atmospheric humidity.

In a case when the humidity detected by the humidity detection section is equal to or higher than first threshold humidity and also when the temperature detected by the temperature detection section is equal to or higher than a threshold temperature, the heating control section executes heat-generation heating control to heat and dry the surface of the photoconductive drum, while when the humidity detected by the humidity detection section is equal to or higher than first threshold humidity and also when the temperature detected by the temperature detection section is less than the threshold temperature, the heating control section executes slidingly-rubbing heating control in which developing operation is performed by the developing device to cause toner adhesion to the surface of the photoconductive drum, and by supplying the adhering toner to an abutting part between the slidingly-rubbing roller and the photoconductive drum without transferring the toner to the transfer object by the transfer member and also simultaneously driving the slidingly-rubbing roller, and the surface of the photoconductive drum is heated and dried by frictional heat generated by the polishing of the surface of the photoconductive drum at the abutting part.

BRIEF DESCRIPTION OF THE DRAWINGS

FIG. 8 is a table showing results obtained by performing a print test for related art and the first and second embodiments.

DETAILED DESCRIPTION

Overall Configuration

Hereinafter, the embodiments of this disclosure will be described in detail with reference to the drawings. Note that, however, this disclosure is not limited to the embodiments described below.

[First Embodiment]

Figure 1:
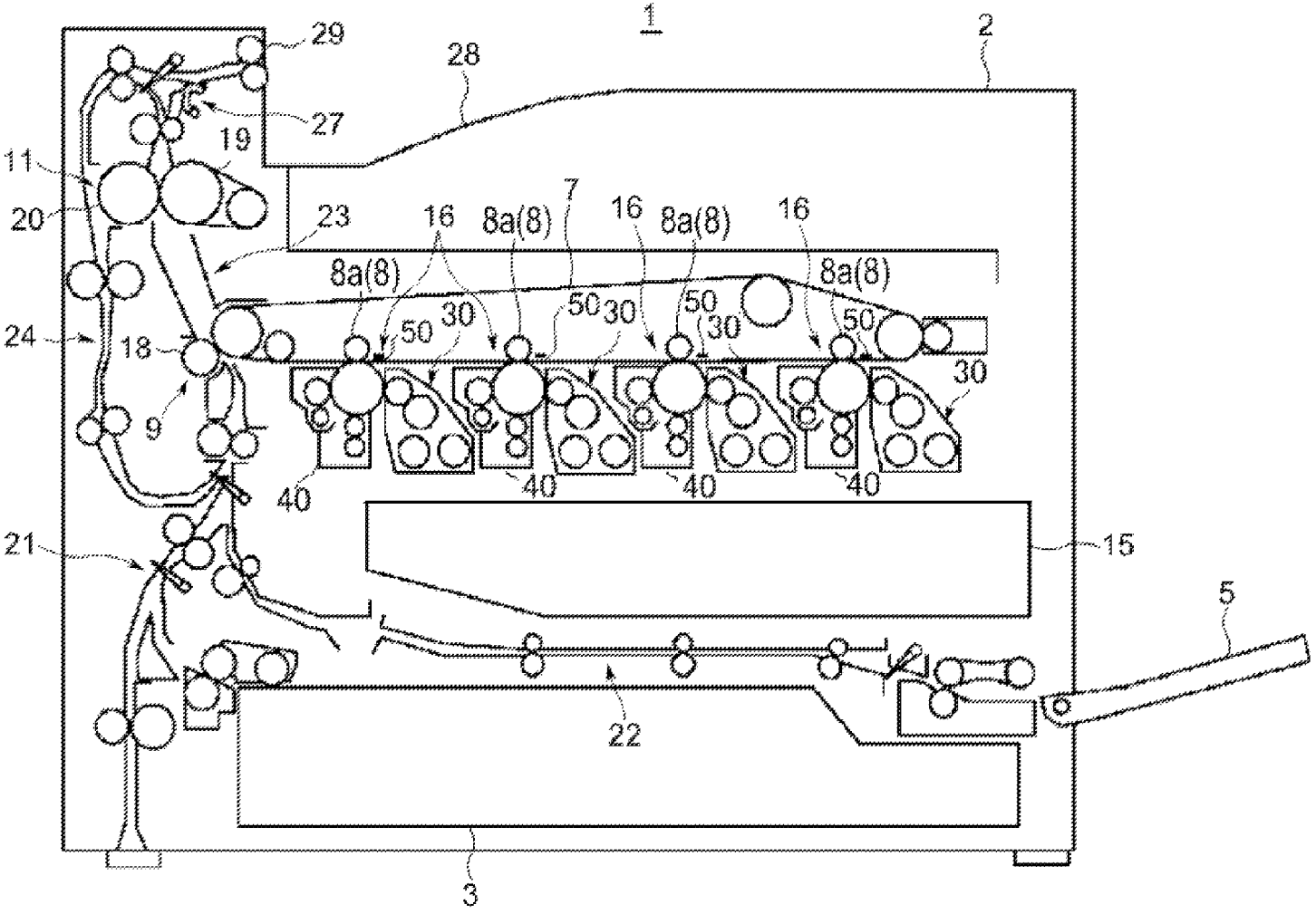
FIG. 1 is a sectional view showing schematic configuration of an image forming apparatus according to embodiments.

FIG. 1 shows an image forming apparatus 1 according to the embodiments. This image forming apparatus 1 is, for example, a tandem-type color printer, and includes: an intermediate transfer belt 7, a primary transfer sections 8 and a secondary transfer section 9, a fixing section 11, an optical scanner 15, a plurality of image formation sections 16, and first to fourth paper conveyance sections 21 to 24.

Arranged at the inner bottom of a main body 2 of the image forming apparatus 1 is a paper feed cassette 3. The paper feed cassette 3 stores therein paper (not shown), for example, non-printed cut paper, superposed on one another. This paper is delivered towards upper left of the paper feed cassette 3 in FIG. 1 individually in a separate manner.

The first paper conveyance section 21 is provided laterally of the paper feed cassette 3. The first paper conveyance section 21 is arranged along a left side surface of the main body 2. The first paper conveyance section 21 receives the paper delivered from the paper feed cassette 3, and conveys this paper along the left side surface of the main body 2 to the secondary transfer section 9 located above.

Provided on a right side of the paper feed cassette 3 is a manual paper feed section 5. Loaded at the manual paper feed section 5 is, for example, paper of a size not loaded on the paper feed cassette 3, cardboard, or an OHP sheet. Provided on left of the manual paper feed section 5 is the second paper conveyance section 22. The second paper conveyance section 22 extends substantially horizontally from the manual paper feed section 5 to the first paper conveyance section 21 and merges into the first paper conveyance section 21. The second paper conveyance section 22 receives, for example, the paper delivered from the manual paper feed section 5 and conveys it to the first paper conveyance section 21.

The optical scanner 15 is arranged above the second paper conveyance section 22. Here, the image forming apparatus 1 receives image data transmitted from outside. This image data is transmitted to the optical scanner 15. The optical scanner 15 irradiates the image formation sections 16 with laser light controlled based on the image data.

For example, four image formation sections 16 are provided above the optical scanner 15. Provided laterally of the image formation section 16 is a cleaning device 40 (to be described later on) for cleaning the photoconductive drum 10 provided at the image formation section 16. Also provided near a top end of the photoconductive drum 10 is a heat generator 50 for heating a surface of the drum described above. Provided above each image formation section 16 is the intermediate transfer belt 7 of an endless type. The intermediate transfer belt 7 is wound around a plurality of rollers, and is driven into rotation by a driver, not shown.

The four image formation sections 16, as shown in FIG. 1, are arranged in a row along the intermediate transfer belt 7, and respectively form yellow, magenta, cyan, and black toner images. Specifically, in the image formation sections 16, electrostatic latent images of an original copy image are respectively formed by laser light irradiated by the optical scanner 15, and these electrostatic latent images are developed to thereby form the toner images of the different colors. Details of the image formation sections 16 will be described later on.

The primary transfer sections 8 are respectively arranged above the image formation sections 16. The primary transfer section 8 has a primary transfer roller 8*a* that primarily transfers, onto the surface of the intermediate transfer belt 7, the toner image formed by the image formation section 16. Applied to the primary transfer roller 8*a* by a transfer bias power source 60*c* (see FIG. 3) is a transfer bias. The toner image of each image formation section 16 is transferred onto the intermediate transfer belt 7 at predetermined timing by the transfer bias applied to the primary transfer roller 8*a*. Thus, formed on the surface of the intermediate transfer belt 7 is a color toner image in which the toner images of the four colors, i.e., yellow, magenta, cyan, and black are superposed on one another.

The secondary transfer section 9 has a secondary transfer roller 18 arranged on a left side of the intermediate transfer belt 7. To the secondary transfer roller 18, the transfer bias is applied by the transfer bias power source 60*c*. The secondary transfer roller 18 sandwiches paper with the intermediate transfer belt 7. Thus, the toner image on the intermediate transfer belt 7 is transferred onto the paper by the transfer bias applied to the secondary transfer roller 18.

The fixing section 11 is provided above the secondary transfer section 9. Formed between the secondary transfer section 9 and the fixing section 11 is the third paper feed section 23 that conveys, to the fixing section 11, the paper on which the toner image has been secondarily transferred.

The fixing section 11 has: a heating roller 19 and a pressure roller 20 each of which rotates. By sandwiching the paper with the heating roller 19 and the pressure roller 20, the fixing section 11 heats and pressurizes the toner image, which has been transferred onto the paper, to thereby fix it on the paper.

Provided above the fixing section 11 is a split section 27. When double-sided printing is not to be performed, the paper discharged from the fixing section 11 is discharged from the split section 27 to a paper discharge section 28 formed at the top of the image forming apparatus 1.

A discharge port portion through which the paper is discharged from the split section 27 towards the paper discharge section 28 functions as a switchback section 29. When double-sided printing is to be performed, a direction in which the paper discharged from the fixing section 11 is conveyed is switched at the switchback section 29.

—Image Formation Section—

Figure 2:
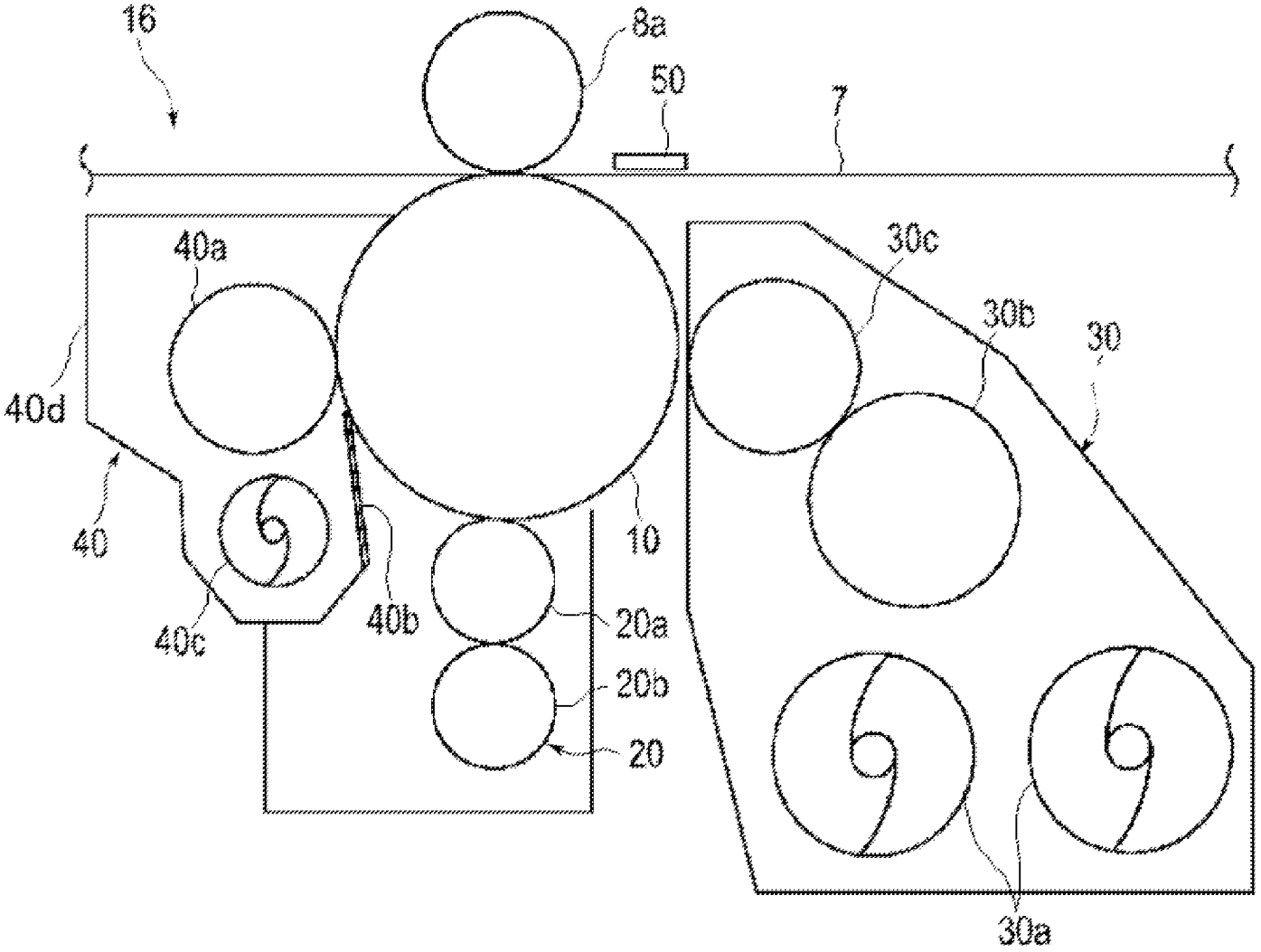
FIG. 2 is an enlarged view showing, on an enlarged scale, an image formation section and a cleaning device located on a side thereof

Next, details of the image formation section 16 will be described with reference to FIG. 2.

The image formation section 16 has: the photoconductive drum 10, a charger 20, a developing device 30, and the heat generator 50.

The photoconductive drum 10 is of a cylindrical shape, and has a photoconductive layer of an a-Si material formed across its entire outer circumferential surface (surface). The photoconductive drum 10 is rotatably supported by a shaft member (not shown) penetrating through its shaft center part.

The charger 20 is arranged under the photoconductive drum 10. The charger 20 has: a charge roller 20*a* applying a charge bias to the surface of the photoconductive drum 10 by slidingly touching this drum; and a charge cleaning roller 20*b* for cleaning the charge roller 20*a*. The charge roller 20*a* is connected to a charge bias power source 60*b* (see FIG. 3). For the charger 20, a charge bias is applied to the photoconductive drum 10 via the charger 20 whereby the surface of the photoconductive drum 10 is charged to predetermined potential. In this state, laser light is irradiated by the optical scanner 15 to the surface of the photoconductive drum 10, thereby forming an electrostatic latent image.

The developing device 30 is arranged laterally of the photoconductive drum 10. The developing device 30 has: two toner conveying screws 30*a*, a magnetic roller 30*b*, and a developing roller 30*c*. The developing roller 30*c* is connected to a development bias power source 60*a* (see FIG. 3). The developing device 30 forms a thin toner layer on the developing roller 30*c* by use of a magnetic brush standing up on a surface of the magnetic roller 30*b*, and also applies a development bias with the same polarity (positive) as that of the toner to the developing roller 30*c* whereby the toner flies to the drum surface. As a result of adhesion of this flown toner to the electrostatic latent image formed on the surface of the photoconductive drum 10, the electrostatic latent image is developed whereby the toner image is formed on the drum surface.

—Cleaning Device—

Next, details of the cleaning device 40 will be described with reference to FIG. 2.

The cleaning device 40 is arranged on a side of the photoconductive drum 10 opposite to the side on which the developing device 30 is arranged. The cleaning device 40 has: a slidingly-rubbing roller 40*a*, a cleaning blade 40*b*, a collecting screw 40*c*, and a cleaning case 40*d*.

The slidingly-rubbing roller 40*a* is made in pressure-contact with the photoconductive drum 10 with predetermined pressure. The slidingly-rubbing roller 40*a* abuts the photoconductive drum 10. The slidingly-rubbing roller 40*a* is driven by a driver (not shown). The driver causes the surface of the slidingly-rubbing roller 40*a* to rotate in the same rotation direction as the surface of the photoconductive drum 10 at the abutting part. Thus, the slidingly-rubbing roller 40*a* functions as a cleaning member that polishes the drum surface by use of a polishing agent contained in the toner. This slidingly-rubbing roller 40*a*, as described later on, is used not only for the purpose of cleaning the photoconductive drum 10 but also for the purpose of heating the photoconductive drum 10.

The cleaning blade 40*b* abuts the surface of the photoconductive drum 10 on a side more downstream in a rotation direction than a portion of the drum surface abutting the sliding roller 40*a*. The cleaning blade 40*b* is configured to scrape off the toner adhering to the surface of the photoconductive drum 10 and drop it into the cleaning case 40*d*. The remaining toner removed from the surface of the photoconductive drum 10 by the cleaning blade 40*b* is discharged to outside of the cleaning device 40 in connection with rotation of the collecting screw 40*c*.

Arranged between the cleaning device 40 and the charger 20 is an de-electrifying lamp, not shown. The de-electrifying lamp removes charges remaining on the surface of the photoconductive drum 10 by light irradiation to the drum surface.

The heat generator 50 described above is arranged at a position near a top side of the transfer belt and also adjacent to the surface of the photoconductive drum 10. The heat generator 50 is composed of, for example, a planar heater. The heat generator 50 is arranged between the developing device 30 and the cleaning device 40 in a planar view. Thus, the heat generator 50 is arranged at a position located as remotely as possible from the toner-storing devices such as the developing device 30 and the cleaning device 40. This consequently prevents toner condensation as a result of heat generation from the heat generator 50.

—Configuration of Control System—

Figure 3:
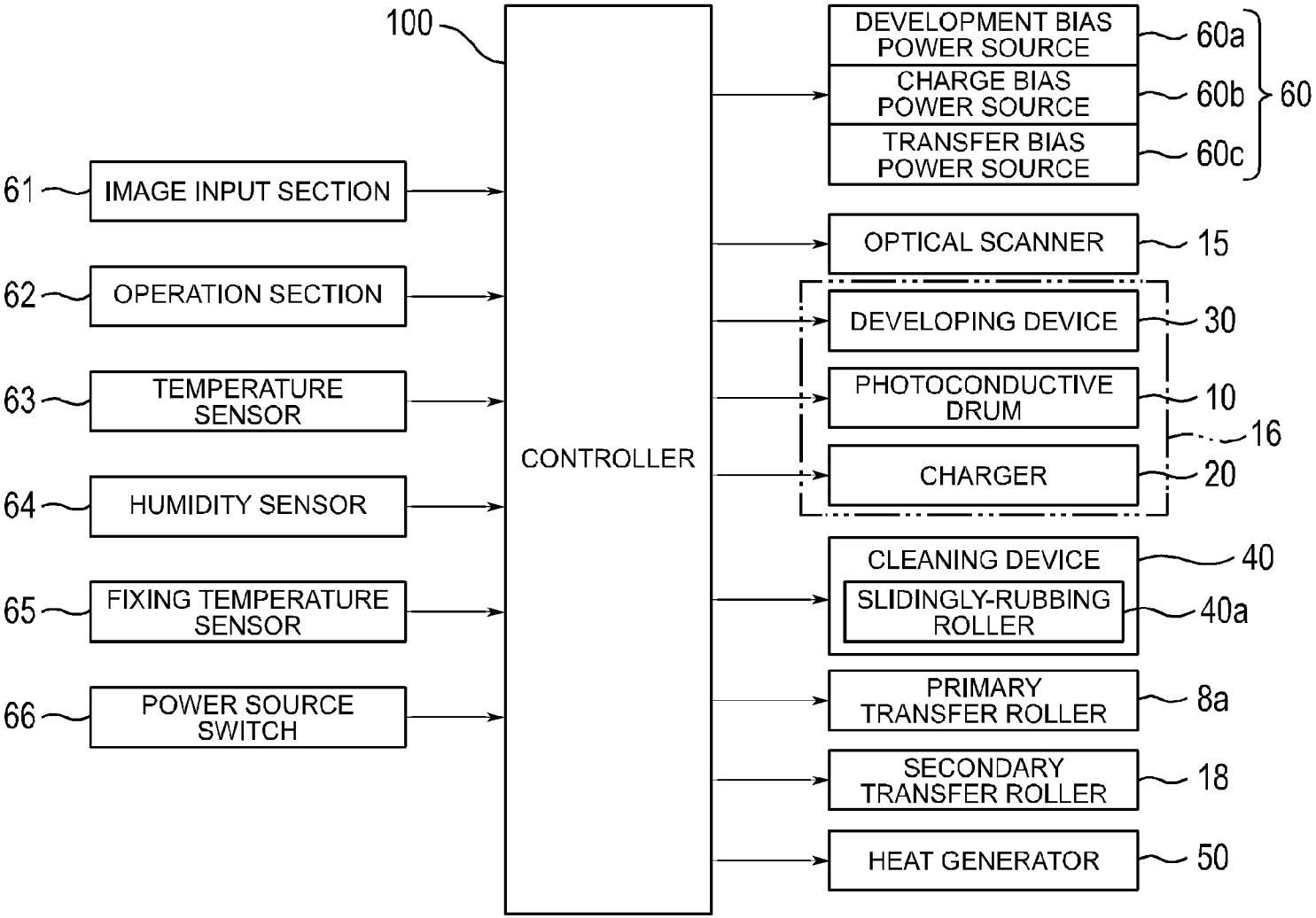
FIG. 3 is a block diagram showing configuration of a control system.

Next, referring to FIG. 3, the configuration of the control system of the image forming apparatus 1 described above will be described. The image forming apparatus 1 has a controller 100 that controls overall operation of the image forming apparatus 1. The controller 100 is composed of a microcomputer having a CPU, a RAM, a ROM, etc. The controller 100 controls the devices and control components in the image forming apparatus 1 based on input signals inputted from an image input section 61, an operation section 62, an atmospheric temperature sensor 63, an atmospheric humidity sensor 64, a fixing temperature sensor 65, a power switch 66, etc. Listed as these devices and control components are: for example, the optical scanner 15, the developing device 30, the photoconductive drum 10, the charger 20, the cleaning device 40, the primary transfer roller 8*a*, the secondary transfer roller 18, and the heat generator 50 described above, and a bias power source 60. The bias power source 60 includes: the development bias power source 60*a*, the charge bias power source 60*b*, and the transfer bias power source 60*c*.

The image input section 61 receives image data transmitted from an external terminal, for example, a personal computer, and outputs it to the controller 100.

The operation section 62 has, for example, a touch-screen liquid crystal display and ten keys. Through operation of the operation section 62 by a user, various settings, such as the number of copies to be printed, can be made and printing start instructions can be provided. The operation section 62 outputs operation, which has been made by the user, as an operation signal to the controller 100.

The atmospheric temperature sensor 63 detects an atmospheric temperature in the main body 2 of the image forming apparatus 1 (hereinafter, referred to as in-apparatus temperature), and outputs a signal obtained through this detection to the controller 100. The atmospheric humidity sensor 64 detects atmospheric humidity in the main body 2 of the image forming apparatus 1 (hereinafter, referred to as in-apparatus humidity), and outputs a signal obtained through this detection to the controller 100. The fixing temperature sensor 65 detects a temperature of the heating roller 19 provided at the fixing section 11, and outputs a signal obtained through this detection to the controller 100.

The power switch 66 is composed of a push-button switch that can be operated by the user. The power switch 66 is electrically connected to a power source provided in the main body 2, and the power switch 66 is turned on by the user whereby power is supplied from the power source to the controller 100.

The controller 100 described above executes a control program stored in the ROM, not shown, to thereby execute an image formation control, a mode switching control, a cleaning control, and a photoconductor heating control.

In the image formation control described above, the paper is conveyed by the paper conveyance sections 21 to 24, and also an image is printed on the paper by the image formation sections 16, the transfer sections 8 and 9, and the fixing section 11 provided on a conveyance path.

In the mode switching control described above, the image forming apparatus 1 is selectively switched between a normal power mode and a power-saving sleep mode. More specifically, when the power source of the image forming apparatus 1 is turned on as a result of ON-operation of the power switch 66 by the user, the controller 100 first activates the image forming apparatus 1 in the normal power mode. In the normal power mode, the power is supplied to the controller 100 and all the devices connected to the controller 100. If a state in which the operation signal from the operation section 62 is not detected continues for a predetermined period of time after the power source of the image forming apparatus 1 is turned on, the controller 100 switches the image forming apparatus 1 from the normal power mode to the sleep mode.

In the sleep mode, for example, the power is supplied only to the image input section 61 for receiving image data.

In the cleaning control described above, by using the residual toner remaining on the surface of the photoconductive drum 10 without being transferred to the intermediate transfer belt 7 by the primary transfer roller 8*a* at time of image formation, the surface of the photoconductive drum 10 is polished by the slidingly-rubbing roller 40*a*. In the cleaning control, the controller 100 makes a control such that a circumferential speed of the slidingly-rubbing roller 40*a* becomes slower than a circumferential speed of the photoconductive drum 10, and a circumferential speed ratio between them (the circumferential speed of the slidingly-rubbing roller 40*a*/the circumferential speed of the photoconductive drum 10) is, for example, 0.8 in this embodiment.

The photoconductor heating control described above is a control of heating and drying the photoconductive drum 10 so that moisture is not absorbed to the surface of the photoconductive drum 10.

The controller 100 selectively executes, as the photoconductor heating control, either of heat-generation heating control using the heat generator 50 and slidingly-rubbing heating control using the slidingly-rubbing roller 40*a*.

In the heat-generation heating control, a heating command is provided to the heat generator 50 by the controller 100. The heat generator 50, upon reception of the heating command from the controller 100, generates heat to heat the surface of the photoconductive drum 10.

In the slidingly-rubbing heating control, the following processing is executed by the controller 100. Specifically, first, development operation is executed by the developing device 30 to cause toner adhesion to the surface of the photoconductive drum 10. More specifically, without charging the surface of the photoconductive drum 10 by the charge roller 20*a*, a development bias is applied to the developing roller by the development bias power source 60*a*. As a result, the toner adheres to the surface of the photoconductive drum 10 in a solid image state.

After the toner adhesion to the surface of the photoconductive drum 10 in the aforementioned manner, without being transferred to the intermediate transfer belt 7 by the primary transfer roller 8*a*, this toner is supplied to the part where the slidingly-rubbing roller 40*a* described above and the photoconductive drum 10 abut each other. More specifically, for example, the transfer bias may not be applied to the primary transfer roller 8*a*, or a transfer bias with polarity opposite to that at time of image formation may be applied to the primary transfer roller 8*a*.

In a state in which the slidingly-rubbing roller 40*a* and the photoconductive drum 10 abut each other, the slidingly-rubbing roller 40*a* is driven into rotation whereby the surface of the photoconductive drum 10 is polished by the polishing agent contained in the toner and frictional heat generated from the polishing heats and dries the surface of this photoconductive drum 10. The circumferential speed of the slidingly-rubbing roller 40*a* is controlled to be slower than that of the photoconductive drum 10, and the circumferential speed ratio between them (the circumferential speed of the slidingly-rubbing roller 40*a*/the circumferential speed of the photoconductive drum 10) is, for example, 0.7 in this embodiment.

Therefore, the circumferential speed difference between the slidingly-rubbing roller 40*a* and the photoconductive drum 10 described above can be said to be larger at time of execution of the slidingly-rubbing heating control than at time of execution of the cleaning control.

Figure 4:
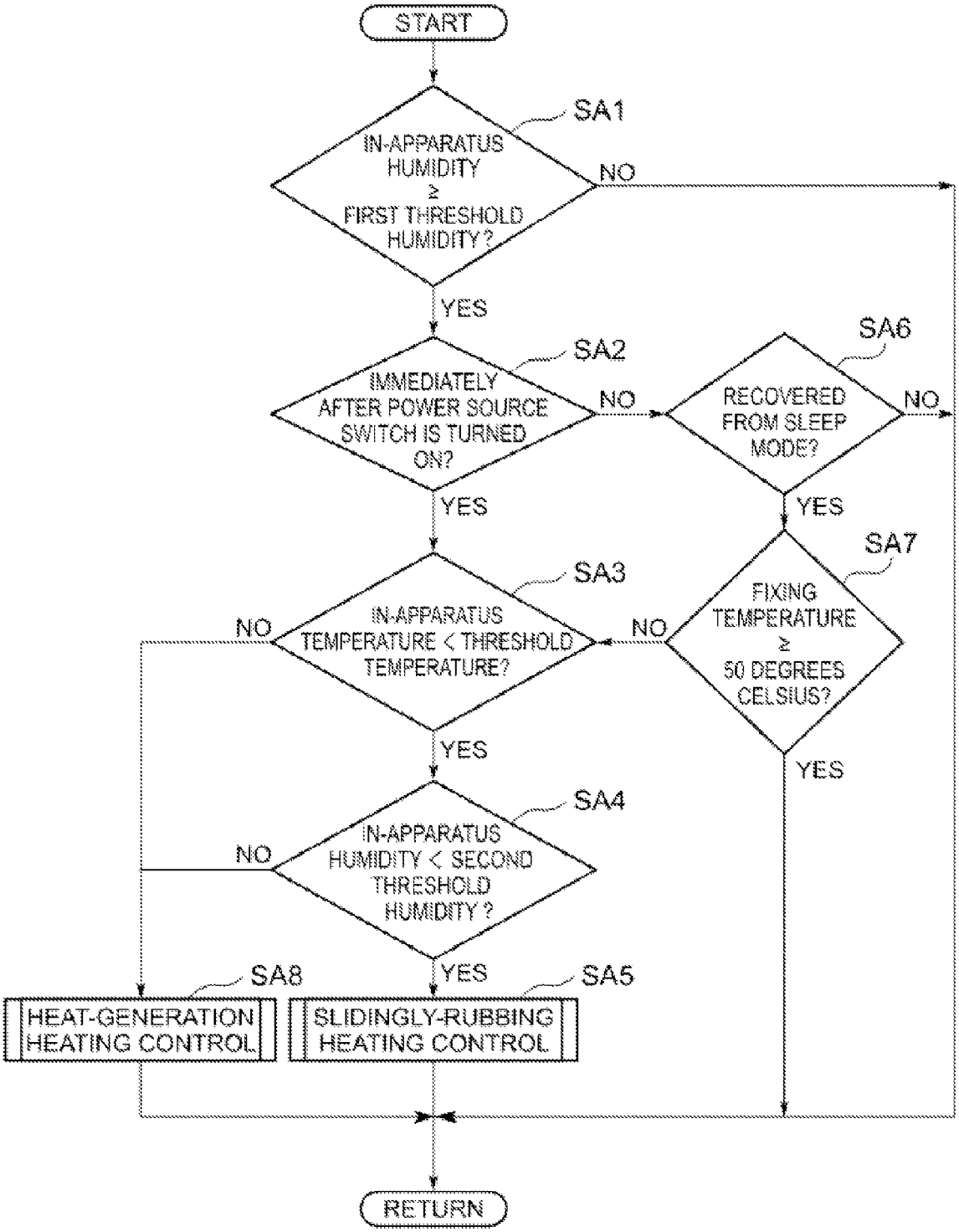
FIG. 4 is a flowchart showing photoconductor heating control in a controller.

Next, the photoconductor heating control in the controller 100 will be described in detail with reference to a flowchart of FIG. 4.

In step SA1, based on the detection signal inputted from the atmospheric humidity sensor 64, it is determined whether or not the in-apparatus humidity is equal to or higher than first threshold humidity (for example, 60% in this embodiment), and the processing returns if this determination is NO while the processing proceeds to step SA2 if the determination is YES.

In step SA2, based on the operation signal inputted from the power switch 66, it is determined whether or not it is immediately after the power switch 66 is switched from OFF to ON (for example, within 10 minutes after the power switch 66 was switched from OFF to ON in a state before inside of the apparatus gets sufficiently warm), and the processing proceeds to step SA6 if this determination is NO while the processing proceeds to step SA3 if the determination is YES.

In step SA3, based on the detection signal inputted from the atmospheric temperature sensor 63, it is determined whether or not the in-apparatus temperature is less than a preset threshold temperature, and the processing proceeds to SA8 if this determination is NO while the processing proceeds to step SA4 if the determination is YES.

In step SA4, based on the detection signal inputted from the atmospheric humidity sensor 64, it is determined whether or not the in-apparatus humidity is less than second threshold humidity (for example, 90% in this embodiment) that is larger than the first threshold humidity, and the processing proceeds to step SA8 if this determination is NO while the processing proceeds to step SA5 if the determination is YES.

In step SA5, the slidingly-rubbing heating control described above is executed, and the processing returns after an appropriate period of time.

In step SA6 to which the processing proceeds if the determination is NO in step SA2, it is determined whether or not the switching from the sleep mode to the normal power mode described above (recovery from the sleep mode) has been detected, and the processing returns if this determination is NO while the processing proceeds to step SA7 if the determination is YES.

In step SA7, based on the detection signal inputted from the fixing temperature sensor 65, it is determined whether or not a temperature of the heating roller 19 (that is, a toner fixation temperature) is equal to or higher than 50 degrees Celsius, and the processing proceeds to step SA3 assuming that sleep time of the image forming apparatus 1 has exceeded predetermined time (assuming that the surface of the photoconductive drum 10 is cooled to a degree that requires its reheating) if this determination is NO while the processing returns assuming that the sleep time of the image forming apparatus 1 is equal to or shorter than the predetermined time if the determination is YES.

In step SA8 to which the processing proceeds if the determination is NO in steps SA3 and SA4, the heat-generation heating control described above is executed, and the processing returns after an appropriate period of time.

Figure 5:
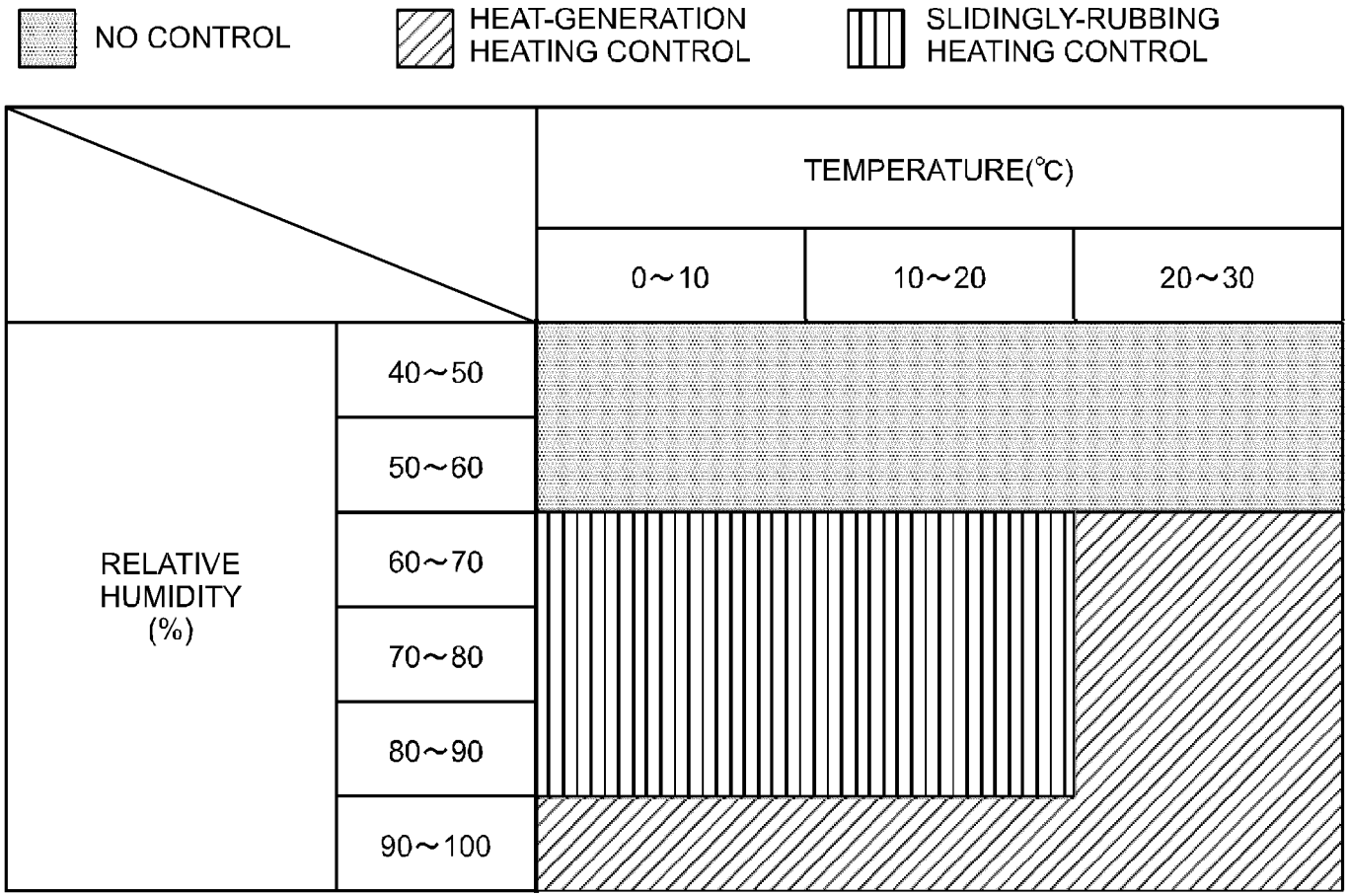
FIG. 5 is a map showing the photoconductor heating control in the controller.

FIG. 5 is a map prepared for visual understanding of the photoconductor heating control performed by the controller 100. This figures proves that the photoconductor heating control is not executed under a low humidity environment in which the in-apparatus humidity is less than the first threshold humidity (for example, 60%), and it is executed under a high humidity environment in which the in-apparatus humidity is equal to or higher than the first threshold humidity. It proves that in a high temperature and high humidity environment which is included in the high humidity environment described above and in which the atmospheric temperature is equal to or higher than a threshold temperature (for example, 20 degrees Celsius), the heat-generation heating control using the heat generator 50 is executed while in a low temperature and high humidity environment which is included in the high humidity environment described above and in which the atmospheric temperature is less than the threshold temperature (for example, 20 degrees Celsius), the slidingly-rubbing heating control using the slidingly-rubbing roller 40*a* is executed.

Therefore, in the first embodiment described above, under the low temperature and high humidity environment in which the intermediate transfer belt 7 is easily cooled, without using the heat generator 50 arranged near the intermediate transfer belt 7, the surface of the photoconductive drum 10 can be heated by using the frictional heat provided by the slidingly-rubbing roller 40*a*. Thus, it avoids a large difference between a belt portion heated by the heat generator 50 and a belt portion not heated thereby as a result of local heating of the intermediate transfer belt 7 by the heat generator 50 under the low temperature and high humidity environment. In turn, deterioration in image quality of a printed image as a result of, for example, appearance of a streaked image in the printed image can be prevented.

Typically, it is easily thought that a heat generator may be arranged separately from a photoconductive drum at a place where no toner condensation problem occurs. However, attempts to realize such arrangement in a limited space results in inevitable arrangement of the heat generator, for example, near the transfer belt in many cases. Particularly in a tandem-type color machine currently under development, compared to a monochrome machine, the number of image formation units is larger and spatial limitations are greater accordingly, and in view of design layout, the heat generator is arranged near the transfer belt in many cases.

However, the arrangement of the heat generator near the transfer belt locally heats the transfer belt by the heat generator, which therefore results in a large difference in surface temperature between the belt portion heated by the heat generator and the belt portion not heated thereby under a low temperature environment in which the transfer belt is easily cooled. Thus, there arises a large difference in belt electric resistance value between the heated portion and the non-heated portion of the transfer belt, which in turn leads to a difference in transfer performance. This consequently raises a problem that the image quality of a printed image deteriorates due to, for example, appearance of a streaked image on the printed image.

On the contrary, according to the first embodiment described above, such problems do not arise, permitting the prevention of the deterioration in the image quality of the printed image.

Moreover, in the first embodiment described above, even under the low temperature and high humidity environment, under an ultra-high humidity environment such that the in-apparatus humidity is equal to or higher than second threshold humidity (for example, 90%), not the slidingly-rubbing heating control but the heat-generation heating control is executed. As a result, under the ultra-high humidity environment, by putting a priority on prevention of humidity absorption on the surface of the photoconductive drum 10, remarkable deterioration in the image quality of the printed image can be suppressed.

Moreover, in the first embodiment described above, provided is a larger circumferential speed difference between the slidingly-rubbing roller 40*a* and the photoconductive drum 10 at time of execution of the slidingly-rubbing heating control than at time of execution of the cleaning control. This makes it possible to increase frictional heat generated at the time of the execution of the slidingly-rubbing heating control to further improve effect of heating the photoconductive drum 10 by the slidingly-rubbing heating control.

[Second Embodiment]

Figure 6:
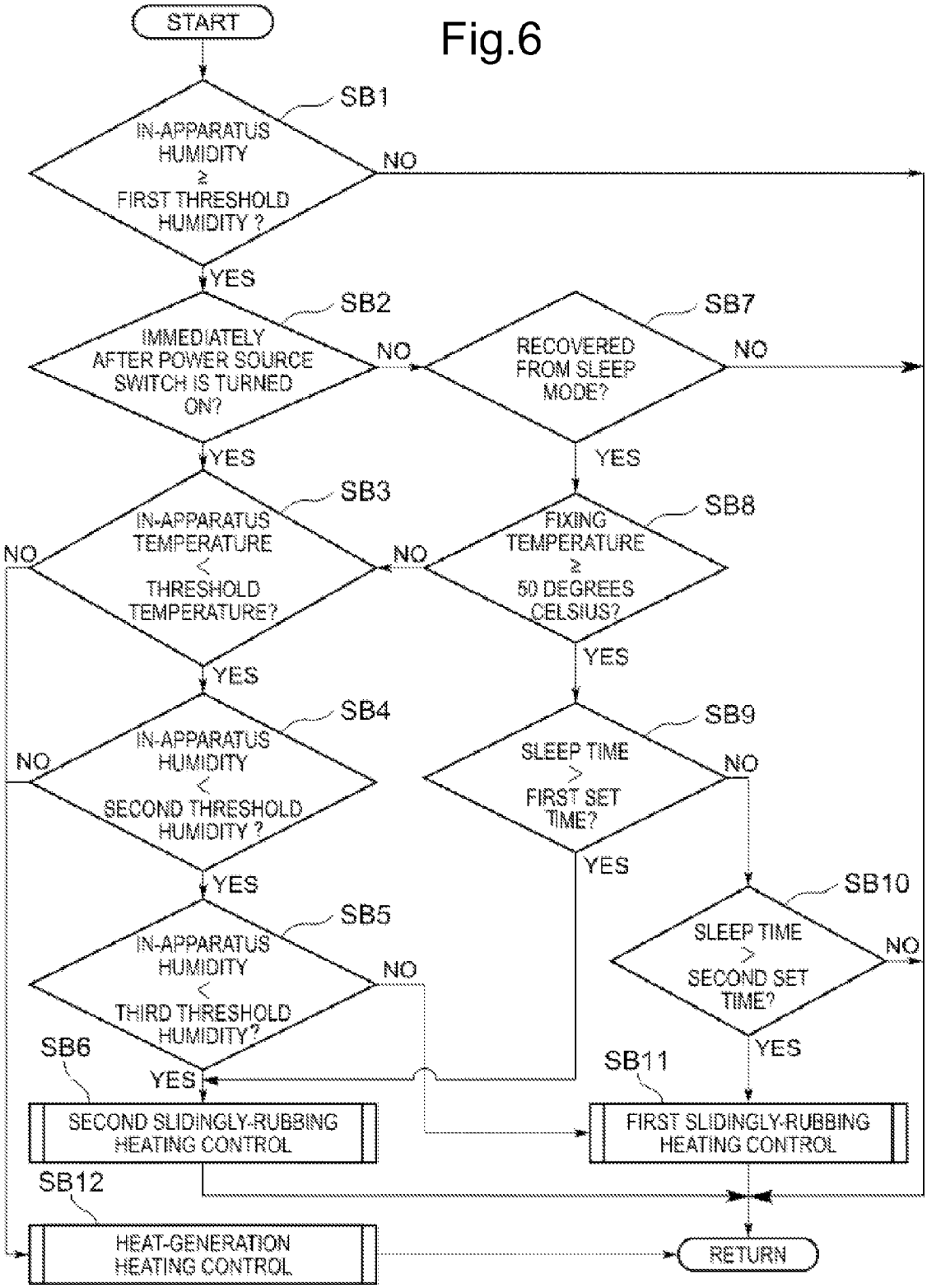
FIG. 6 is a diagram showing a second embodiment in correspondence with FIG. 4.

FIG. 6 shows the second embodiment. In the second embodiment, photoconductor heating control in the controller 100 is different from that of the first embodiment.

Specifically, in the second embodiment, for the slidingly-rubbing heating control, the controller 100 executes two divided controls including a first slidingly-rubbing heating control and a second slidingly-rubbing heating control. The first slidingly-rubbing heating control and the second slidingly-rubbing heating control differ from each other in heating time, and the heating time of the first slidingly-rubbing heating control is longer than that of the second slidingly-rubbing heating control. The controller 100, in accordance with the in-apparatus humidity, selectively switches between the first slidingly-rubbing heating control and the second slidingly-rubbing heating control for the execution.

Hereinafter, details of the photoconductor heating control executed by the controller 100 in the second embodiment will be described with reference to FIG. 6.

Processes of steps SB1 to SB4 are respectively the same as those of steps SA1 to SA4 in the first embodiment, and thus their description will be omitted.

In step SB5, based on the detection signal inputted from the atmospheric humidity sensor 64, it is determined whether or not the in-apparatus humidity is less than preset third threshold humidity (that is larger than the first threshold humidity but lower than the second threshold humidity, for example, 75% in this embodiment), and the processing proceeds to step SB11 if this determination is NO while the processing proceeds to step SB6 if the determination is YES.

In step SB6, the second slidingly-rubbing heating control is executed. Execution time (heating time) of this second slidingly-rubbing heating control is, for example, three minutes in this embodiment.

Processes of steps SB7 and SB8 in the second embodiment are respectively the same as those of steps SA6 and SA7 in the first embodiment, and thus their description will be omitted.

In step SB9 to which the processing proceeds if the determination is YES in step SB8, it is determined whether or not time for which the sleep mode is set immediately before recovery to the normal power mode in SB7 (that is, sleep time) exceeds preset first set time (for example, 60 minutes in this embodiment), and the processing proceeds to step SB6 if this determination is YES while the processing proceeds to step SB10 if the determination is NO. Note that at time of image formation, the toner fixing temperature is close to, for example, 160 degrees Celsius, but the first set time is shorter than time normally required for the fixing temperature to fall from near 160 degrees Celsius to 50 degrees Celsius.

In step SB10, it is determined whether or not the sleep time described above exceeds second set time (for example, 30 minutes in this embodiment) that is shorter than the preset first set time, and the processing returns if this determination is NO while the processing proceeds to step SB11 if the determination is YES.

In step SB11, the first slidingly-rubbing heating control is executed.

In step SB12 to which the processing proceeds if the determination is NO in steps SB3 and SB4, the heat-generation heating control is executed.

Figure 7:
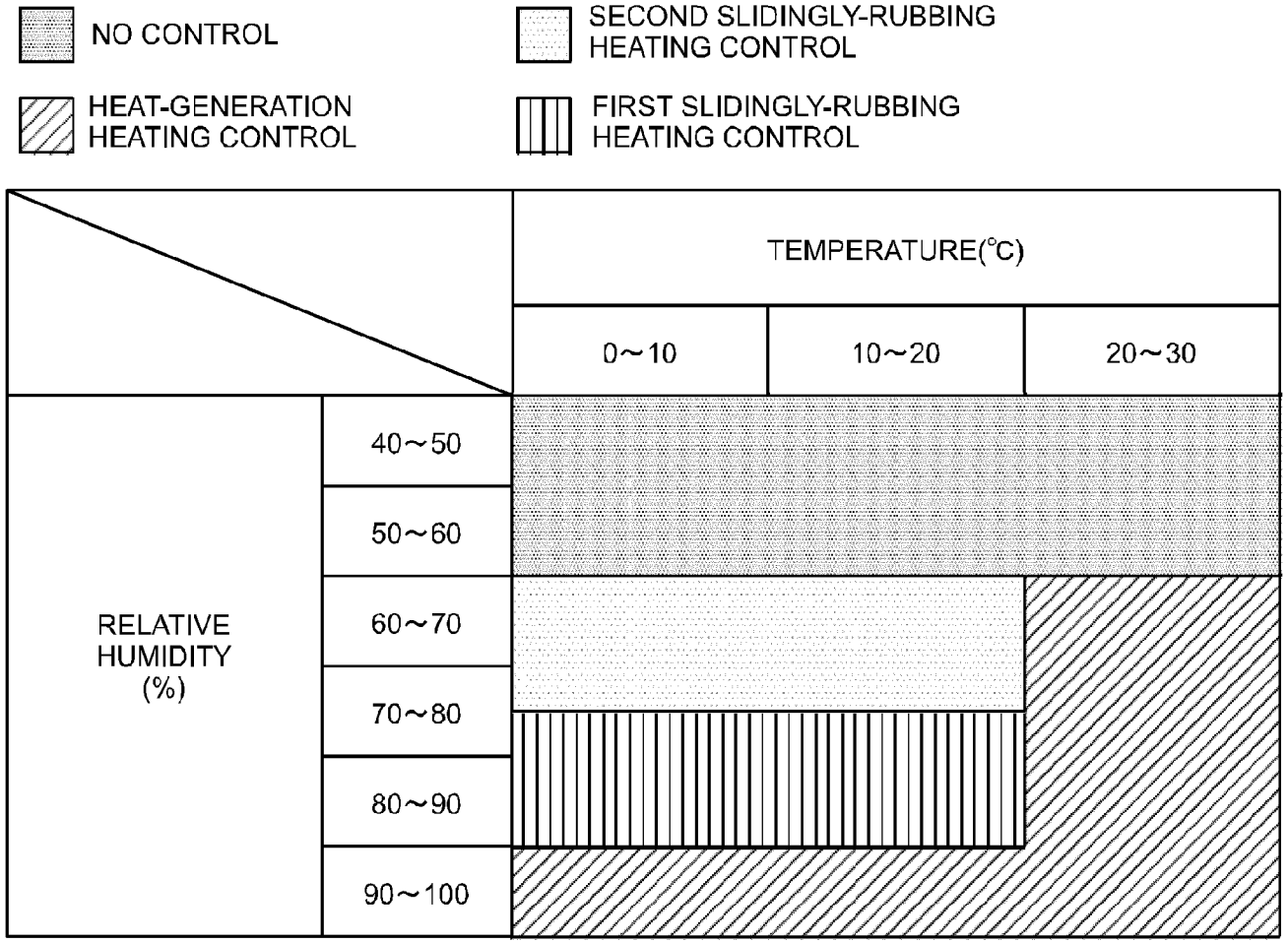
FIG. 7 is a diagram showing the second embodiment in correspondence with FIG. 5.

FIG. 7 is a map prepared for visual understanding of the photoconductor heating control in the second embodiment.

According to this figure, unlike the first embodiment, the slidingly-rubbing heating control executed under a low temperature and high humidity environment is divided into a first slidingly-rubbing heating control and a second slidingly-rubbing heating control. More specifically, under the low temperature and high humidity environment described above, on a low humidity side on which the in-apparatus humidity falls below the third threshold humidity (for example, 75%), the second slidingly-rubbing heating control is executed, and on a high humidity side on which the in-apparatus humidity is equal to or higher than the third threshold humidity (for example, 75%), the first slidingly-rubbing heating control of which heating time is longer than that of the second slidingly-rubbing heating control is executed.

Therefore, in the second embodiment described above, longer execution time for the slidingly-rubbing heating control (that is, time for which the slidingly-rubbing roller 40*a* is driven into rotation) can be provided for higher in-apparatus humidity to reliably dry the surface of the photoconductive drum 10.

Moreover, in the second embodiment described above, both the first and second slidingly-rubbing heating controls are executed immediately after the power source of the image forming apparatus 1 is turned on, but they differ in execution condition upon recovery of the image forming apparatus 1 to the normal power mode after switching from the normal power mode to the sleep mode. Specifically, the second slidingly-rubbing heating control is executed if the sleep time exceeds the first set time (for example, 60 minutes) (step SB9) while the first slidingly-rubbing heating control is executed if the sleep time exceeds the second set time (for example, 30 minutes) that is shorter than the first set time (step SB10).

Therefore, rate in which the first slidingly-rubbing heating control is executed by the controller 100 becomes higher than rate in which the second slidingly-rubbing heating control is executed. In other words, when an in-apparatus humidity is high, the heating time in which the slidingly-rubbing heating control is executed by the controller 100 is longer, in comparison with a case the in-apparatus humidity is low. As a result, with higher in-apparatus humidity, the surface of the photoconductive drum 10 can be more often heated and reliably dried.

EXAMPLE

Figure 9:
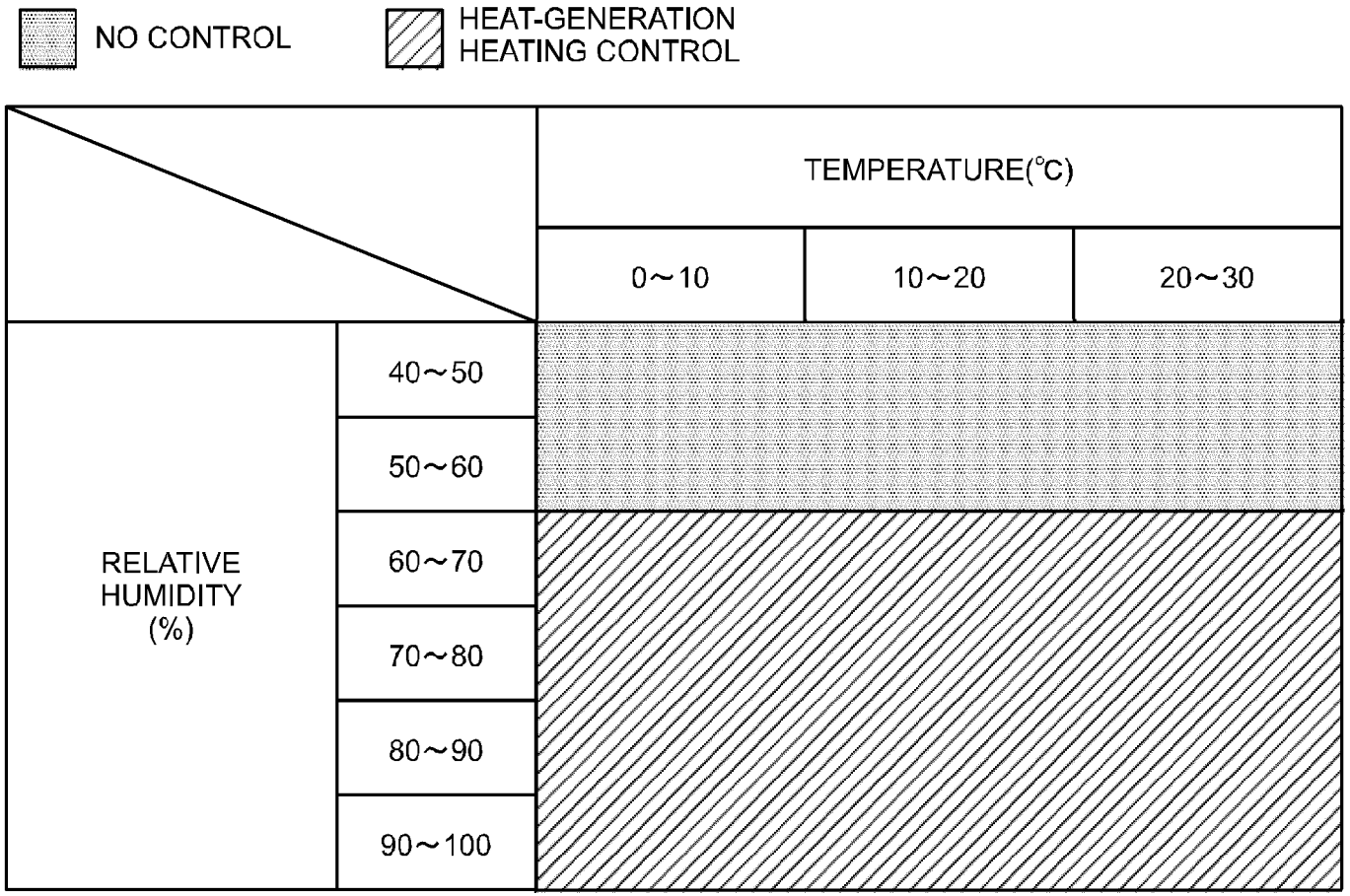
Fig.9 Related Art
FIG. 9 is a diagram showing the related art in correspondence with FIG. 5.

For the first and second embodiments and related art, a print test was actually performed under a low temperature environment (with an in-apparatus temperature of 10 degrees Celsius). FIG. 8 is a table summarizing results of this print test, and FIG. 9 is a map showing photoconductor heating control in the related art. As shown in this map, only the heat-generation heating control is executed in the related art.

"○" in the table of FIG. 8 means that a streaked image did not appear, "X" means that a streaked image appeared on almost all paper, and "Δ" means that a streaked image appeared on part of the paper. According to this table, under an environment in which the in-apparatus humidity is 100%, a streaked image did not appear in any of the related art and the first and second embodiments. This would be because the heat-generation heating control is executed by the controller 100 in any of the cases under the environment in which the in-apparatus humidity is 100%. It can be found that under environments in which the in-apparatus humidity is 60% and 80%, a streaked image appeared in the related art while it did not appear in the first and second embodiments. This would be because, unlike in the related art, the slidingly-rubbing heating control is executed by the controller 100 in the first and second embodiments under the high humidity environments in which the in-apparatus humidity is 60% and 80%.

[Other Embodiments]

In the embodiments described above, the heat generator 50 is configured separately from the photoconductive drum 10, and is provided outside of the photoconductive drum 10, but the heat generator 50 is not limited to this configuration, and, for example, it may be built in the photoconductive drum 10.

In the embodiments described above, the image forming apparatus 1 is a tandem machine, but it is not limited to this, and may be, for example, a monochrome machine.

However, the embodiments described above are particularly valid in tandem machines. In the tandem machines, compared to monochrome machines, spatial limitations are greater and thus it is inevitable to arrange the heat generator near the transfer belt in many cases. In a case where the heat generator is arranged near the transfer belt, under a low temperature environment, there arises a large difference in belt surface temperature between the portion heated by the heat generator and the portion not heated thereby. Thus, the deterioration in the image quality of a printed image easily occurs under the low temperature environment, and the embodiments described above are particularly effective for tandem machines adopting the configuration according to this embodiment.

In each of the embodiments described above, upon execution of the slidingly-rubbing heating control by the controller 100, the toner adhesion to the surface of the photoconductive drum 10 is caused by performing the development operation by the developing device 30 without charging the surface of the photoconductive drum 10 by the charger 20, but the embodiments are not limited thereto. That is, for example, after the charging of the surface of the photoconductive drum 10 by the charger 20, the entire surface may be exposed by the optical scanner 15 and then the development operation may be performed by the developing device 30.

Moreover, in the embodiments described above, the heat-generation heating control is executed under an ultrahigh humidity environment in which the in-apparatus humidity is equal to or higher than the second threshold humidity (for example, 90%), but the embodiments are not limited to this, and for example, the slidingly-rubbing heating control may also be executed under, for example, the ultrahigh humidity environment.

INDUSTRIAL APPLICABILITY

As described above, this disclosure is useful for an image forming apparatus, and is particularly effective for a tandem-color type image forming apparatus.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising:

a photoconductive drum;

a charger charging a surface of the photoconductive drum;

an exposing device exposing the surface of the photoconductive drum to form an electrostatic latent image thereon;

a developing device developing the electrostatic latent image formed on the photoconductive drum by a toner to thereby obtain a toner image;

a transfer member transferring the toner image onto a transfer object at a time of image formation;

a heat generator for heating and drying the surface of the photoconductive drum;

a heating control section controlling operation of the heat generator;

a slidingly-rubbing roller abutting the surface of the photoconductive drum;

a temperature detection section detecting an atmospheric temperature; and a humidity detection section detecting atmospheric humidity, wherein, in a case when the humidity detected by the humidity detection section is equal to or higher than a first threshold humidity and also when the temperature detected by the temperature detection section is equal to or higher than a threshold temperature, the heating control section executes heat-generation heating control to heat and dry the surface of the photoconductive drum, while in a case when the humidity detected by the humidity detection section is equal to or higher than the first threshold humidity and also when the temperature detected by the temperature detection section is less than the threshold temperature, the heating control section executes slidingly-rubbing heating control in which a developing operation is performed by the developing device to cause toner adhesion to the surface of the photoconductive drum, and by supplying the adhering toner to an abutting part between the slidingly-rubbing roller and the photoconductive drum without transferring the toner to the transfer object by the transfer member and also simultaneously driving the slidingly-rubbing roller, and the surface of the photoconductive drum is heated and dried by frictional heat generated by a polishing of the surface of the photoconductive drum at the abutting part.

2. The image forming apparatus according to claim 1, wherein, when the humidity detected by the humidity detection section is equal to or higher than 75 percent, the heating control section is configured to increase a heating time in which the slidingly-rubbing heating control is executed, in comparison with a case when the humidity detected by the humidity detection section is lower than 75 percent.

3. The image forming apparatus according to claim 1, wherein the heating control section is configured to execute the heat-generation heating control when the humidity detected by the humidity detection section is equal to or higher than a second threshold humidity that is larger than the first threshold humidity even when the temperature detected by the temperature detection section is lower than the threshold temperature.

4. The image forming apparatus according to claim 3, wherein, when the humidity detected by the humidity detection section is smaller than the second threshold humidity, when the detected humidity is equal to or higher than a third threshold humidity that is larger than the first threshold humidity and smaller than the second threshold humidity, the heating control section performs the slidingly-rubbing heating control for a longer time than when the detected humidity is equal to or higher than the first threshold humidity but smaller than the third threshold humidity.

5. The image forming apparatus according to claim 1, wherein, when the humidity detected by the humidity detection section is equal to or higher than the first threshold humidity, upon detection of switching from a sleep mode to a normal power mode, in accordance with a duration of time for which the sleep mode was activated, the heating control section performs the slidingly-rubbing heating control by varying a heating time.

6. The image forming apparatus according to claim 1, further comprising a cleaning control section executing a cleaning control of polishing the surface of the photoconductive drum by the slidingly-rubbing roller by using a residual toner remaining on the photoconductive drum without being transferred to the transfer object by the transfer member at the time of image formation, wherein a circumferential speed difference between the slidingly-rubbing roller and the photoconductive drum at a time of execution of the slidingly-rubbing heating control by the heating control section is larger than a circumferential speed difference between the slidingly-rubbing roller and the photoconductive drum at a time of execution of the cleaning control by the cleaning control section.

7. The image forming apparatus according to claim 1, wherein the transfer member is a transfer belt, and the image forming apparatus is a tandem machine having a plurality of the photoconductive drums arranged along the transfer belt.

* * * * *